US012252939B2

(12) United States Patent
Steele et al.

(10) Patent No.: US 12,252,939 B2
(45) Date of Patent: Mar. 18, 2025

(54) DEFLECTOR AND STINGER FOR CONNECTING DOWNHOLE WET MATE CONNECTORS

(71) Applicant: Halliburton Energy Services, Inc., Houston, TX (US)

(72) Inventors: David J. Steele, Carrollton, TX (US); Tyson H. Eiman, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/238,682

(22) Filed: Aug. 28, 2023

(65) Prior Publication Data

US 2024/0309707 A1 Sep. 19, 2024

Related U.S. Application Data

(60) Provisional application No. 63/490,379, filed on Mar. 15, 2023.

(51) Int. Cl.

| | |
|---|---|
| ***E21B 17/02*** | (2006.01) |
| ***E21B 47/12*** | (2012.01) |
| ***E21B 47/135*** | (2012.01) |

(52) U.S. Cl.

CPC ..... *E21B 17/028* (2013.01); *E21B 17/023* (2013.01); *E21B 47/12* (2013.01); *E21B 47/135* (2020.05)

(58) Field of Classification Search

CPC ..... E21B 17/028; E21B 47/12; E21B 17/023

See application file for complete search history.

(56) References Cited

U.S. PATENT DOCUMENTS

| | | | |
|---|---|---|---|
| 7,165,892 | B2 | 1/2007 | Grigsby et al. |
| 7,487,830 | B2 | 2/2009 | Wolters et al. |
| 7,556,093 | B2 | 7/2009 | Grigsby et al. |
| 7,900,698 | B2 | 3/2011 | Stoesz |
| 10,472,933 | B2 | 11/2019 | Steele |
| 2008/0029274 | A1 | 2/2008 | Rytlewski et al. |

(Continued)

FOREIGN PATENT DOCUMENTS

| | | | | |
|---|---|---|---|---|
| WO | WO-2016043737 | A1 * | 3/2016 | ..... E21B 17/003 |
| WO | 2022109157 | A1 | 5/2022 | |

OTHER PUBLICATIONS

International Search Report and Written Opinion, PCT/US2023/031260, 11 pages, Dec. 5, 2023.

(Continued)

*Primary Examiner* — Catherine Loikith

(74) *Attorney, Agent, or Firm* — Kilpatrick Townsend & Stockton LLP

(57) ABSTRACT

A system can be used to connect downhole fiber optic wet mates. The system can include a first completion system and a second completion system. The first completion system can include a stinger sub-system that can include a first energy transfer line coupled to a first wet mate connector. The second completion system can include a deflector sub-system that can include a deflector positioned adjacent to a second wet mate connector that can be coupled with a second energy transfer line. The deflector can be positioned in the second completion system to deflect the stinger sub-system laterally outward to cause the second wet mate connector to couple with the first wet mate connector.

20 Claims, 6 Drawing Sheets

(56) References Cited

U.S. PATENT DOCUMENTS

| | | | | |
|---|---|---|---|---|
| 2009/0321069 | A1 | 12/2009 | Jonas | |
| 2022/0170346 | A1 | 6/2022 | Steele et al. | |
| 2022/0412190 | A1 | 12/2022 | Hern | |
| 2023/0323738 | A1 * | 10/2023 | Cassidy | E21B 47/12 166/65.1 |

OTHER PUBLICATIONS

Ametek , "HSC Hermetic Seal—Dive Deep Into the Advantages of Underwater Mate-able Electrical Connectors", 2021, 7 pages.

Halliburton Energy Services, Inc , "All-electric completions—Pioneering all-electric completions", available at https://www.halliburton.com/en/completions/well-completions/the-future-of-completions/all-electric-completions at least as early as Feb. 2, 2023, 5 pages.

Halliburton Energy Services, Inc , "Digital Ecosystem", available at https://www.halliburton.com/en/completions/well-completions/the-future-of-completions/digital-ecosystem at least as early as Feb. 2, 2023, 5 pages.

Halliburton Energy Services, Inc , "Halliburton 4.0—Digital gateway to open new possibilities", available at https://www.halliburton.com/en/halliburton-4-0 at least as early as Feb. 2, 2023, 13 pages.

Halliburton Energy Services, Inc , "The Future of Completions—Pushing the limits of technology", available at https://www.halliburton.com/en/completions/well-completions/the-future-of-completions at least as early as Feb. 3, 2023., 7 pages.

TE Connectivity , "Seacon G# Low Profile, Low Loss Optical Performance, Optical Wet-Mate Connector", Marine Oil & Gas, 2019, 2 pages.

* cited by examiner

DEFLECTOR AND STINGER FOR CONNECTING DOWNHOLE WET MATE CONNECTORS

CROSS-REFERENCE TO RELATED APPLICATION

This claims priority to U.S. Provisional Application Ser. No. 63/490,379, filed Mar. 15, 2023 and titled "Deflector and Stinger for Connecting Downhole Wet Mate Connectors," the contents of which are incorporated herein by reference.

TECHNICAL FIELD

The present disclosure relates generally to wellbore operations and, more particularly (although not necessarily exclusively), to a deflector and a stinger for connecting downhole fiber optic wet mates.

BACKGROUND

A wellbore can be formed in a subterranean formation for extracting produced hydrocarbons or other suitable materials. One or more wellbore operations can be performed with respect to the wellbore. The operations can include drilling to form the wellbore, extracting produced hydrocarbons from the wellbore, etc. The wellbore operations can include or otherwise involve using fiber optic cables downhole in the wellbore. In some examples, connecting the fiber optic cables may be technically challenging.

DETAILED DESCRIPTION

Figure 1:
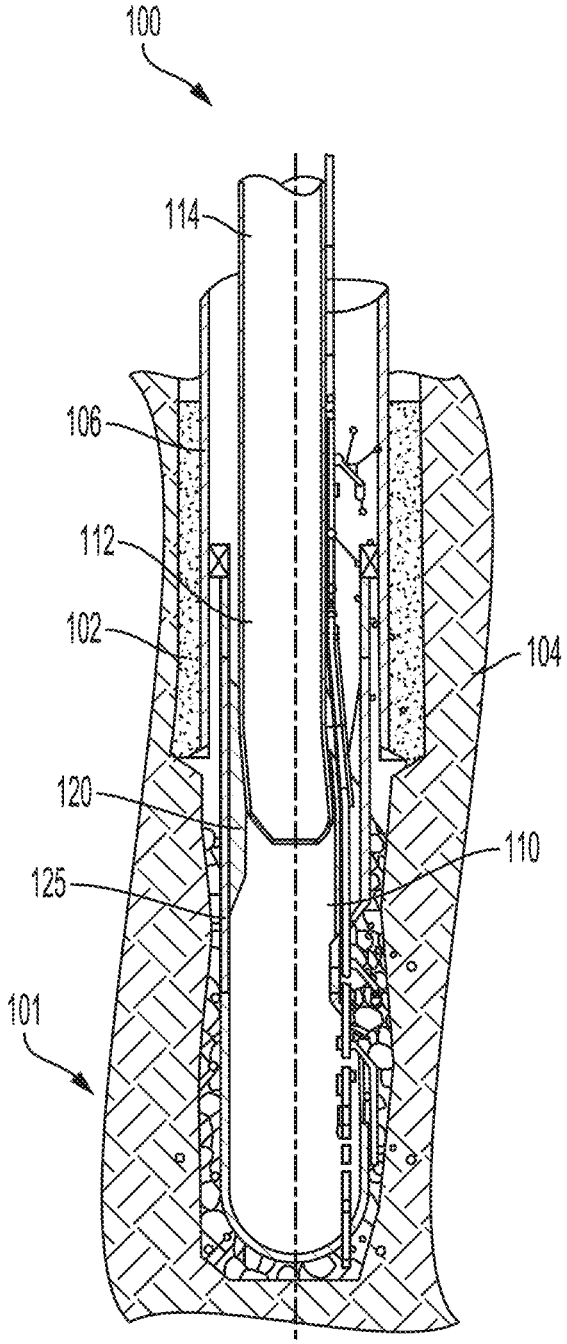
FIG. 1 is a schematic of a well system that can use a deflector and a stinger to connect fiber optic wet mates.

Certain aspects and examples of the present disclosure relate to a stinger and a deflector that can be used to connect downhole wet mate connectors. In some examples, the wet mate connectors may be or include fiber optic wet mates, electric wet mates, hydraulic wet mates, electro-hydraulic wet mates, electro-fiber wet mates, other suitable wet mates, or any combination thereof. The deflector may be a first downhole tool or sub-system that can be installed in a wellbore. The deflector may include a first fiber optic cable that can be used to make measurements in the wellbore. The deflector may additionally include a fiber optic wet mate and a deflector ramp. The stinger may be a second downhole tool or sub-system that can be positioned in the wellbore to connect to the deflector. The stinger may be sized to be positioned in the deflector such that a second fiber optic wet mate of the stinger can be guided to connect to the first fiber optic wet mate of the deflector. Guiding the second fiber optic wet mate can involve the stinger traversing the deflector ramp to be deflected outward such as radially toward an outer diameter of the deflector.

In some examples, connecting a downhole energy transfer line with capability to pass restrictions and have a sub-system carrying the energy transfer line extend laterally outward to maximize the inner diameter through the sub-system for production flow area and passing tools through the sub-system can be challenging. Maintaining the use of an existing indicator coupling with a first inner diameter and also maintaining a large inner diameter through, for example, an upper completion string can enhance one or more wellbore operations.

A wet mate connection can involve, for example, two components, which when mated together, form a wet mate connection. As described herein, the terms "plug" and "socket" may be used to differentiate between the two components. In other examples, the general term "wet mate connector." or "connector," may be used. In some examples, a system can use a socket wet mate connector, for example positioned on a production string, and a mating plug wet mate connector, for example positioned on a completion string. The socket wet mate connector can be run-in-hole on the production string and can be guided or urged by deflection of the string at the location of the socket wet mate connector to the eccentrically mounted plug connector on the completion string. The deployment by deflection can allow for larger inner diameters to be used through an interface of a stinger sub-system's flow path and a deflector sub-system's flow path for wellbore operations such as production flow area and running or retrieving tools through the inner diameters of the stinger sub-system and deflector sub-system.

In some examples, the system can improve the ability for the wet mate connector to pass restrictions and provide an enlarged inner diameter for the wellbore operations. The system can run the wet mate connector on a reduced overall diameter and can deploy radially outward for connection once downhole. Additionally or alternatively, the system can use one or more existing gravel pack lower completion components above the wet mate connection. The system can incorporate an upper wet mate connector mounted on a stinger sub-system that can pass through restrictions such as packer bores and other gravel pack or fracture pack equipment and can then be urged or guided outward to connect with the mating lower wet mate connector, which can be positioned on a deflector sub-system. A flow area of the stinger sub-system can approximately be an area of the inner diameter of the production string through which tools, fluids, and the like can pass.

In some cases, the flow area of the stinger sub-system can be the first upper flow path. Likewise, the flow area of the production string can be the second upper flow path. The outward lateral deployment can achieve smaller running outer diameters of the production string connector for passing restrictions and radial deployment to provide larger inner diameters for production flow area, or for a projected area, and passing tools through the wet-mate connector, and the like. For example, an axis of the stinger sub-system's flow path, such as the first upper flow path, may be non-parallel but approximately co-planar with an axis of the deflector sub-system's flow path, such as the second lower flow path, which may optimize a flow area through the stinger sub-system and the deflector sub-system. In some examples, the flow area of the stinger sub-system can be the first upper flow path. Likewise, the flow area of the production string can be the second upper flow path.

The system can use a downhole wet mate connector, orienting sub-system, a deflector sub-system, a stinger sub-system, other suitable sub-systems, or any combination thereof. A lower portion of the wet mate can be mounted to the deflector sub-system, which can be positioned on the completion string and run in the wellbore with the gravel pack completion equipment, or with other suitable wellbore completion equipment. The upper portion of the wet mate connector can be mounted to the stinger sub-system and can be run to depth on the production string, or on other suitable means for conveying the stinger sub-system downhole. When the upper portion of the wet mate is run in the wellbore, the stinger sub-system can be rotationally oriented by the orienting sub-system to align the upper portion of the wet mate connector with the lower wet mate connector. The upper wet mate connector can enter the deflector sub-system, which can deflect the upper wet mate radially outward to connect to the lower wet mate connector. Deflecting the stinger sub-system laterally outward can allow the completion string to use existing, or new, completion equipment and can provide a large inner diameter on the completion string and a large inner diameter production string that are approximately aligned. Additionally, a flow area with respect to the completion string and the production string may be large.

The ability to provide a large flow area, with the ability to pass tools through a large area, and with the ability to connect energy transfer lines under harsh conditions, such as a dirty environment having solids-contaminated fluids like drilling muds or completion fluid, extreme pressures (e.g., >20,000-psi differential), extreme temperatures (e.g., −20° F. or −28.89° C. to >300° F. or 148.89° C.) etc., can make the system suitable for use in environments including outer space (e.g., satellites, spacecrafts), aeronautics like aircraft, on-ground (e.g., swamps and marshes), below ground (e.g., mines, caves), ocean surface or subsea, and subterranean such as mineral extraction, storage wells (carbon sequestration, carbon capture and storage (CCS), and other energy recovery activities (e.g., geothermal, steam, etc.).

These illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic of a well system 100 that can use a deflector 110 and a stinger 112 to connect fiber optic wet mates according to examples of the present disclosure. The well system 100 can include a wellbore 102 that can extend through a subterranean formation 104 that can include hydrocarbon material such as oil, gas, coal, or other suitable material. Additionally, the wellbore 102 can be formed for carbon capture, utilization, and storage, for water injection with respect to the subterranean formation 104, or any combination thereof. In some examples, a casing string 106 can extend from a well surface into the subterranean formation 104. The casing string 106, a production string 114 or tubing, a lower completion string 125, or any combination thereof can provide a conduit through which fluids, such as production fluids produced from the subterranean formation 104, can travel to the well surface or otherwise suitably with respect to the wellbore 102. As illustrated in FIG. 1, the production fluids may be produced via a production string 114. The casing string 106 can be coupled to walls of the wellbore 102 via cement or other suitable coupling material. For example, a cement sheath can be positioned or formed between the casing string 106 and the walls of the wellbore 102 for coupling the casing string 106 to the wellbore 102. The casing string 106 can be coupled to the wellbore 102 using other suitable techniques. In some examples, the wellbore 102 may not include the casing string 106, or the cement sheath, and, instead, a wall of the wellbore 102, or a portion thereof, may be or otherwise include the subterranean formation 104.

The well system 100 can include the deflector 110 that can be positioned in the wellbore 102 for example via a completion string, which can be guided into the wellbore 102 using, for example, a rig draw works, a work string, or the like. The well system 100 can additionally include a stinger 112 that can be positioned in the wellbore 102 for example via a production string 114. In some examples, the deflector 110 can include a deflection ramp 120 that can be used to deflect the stinger 112 radially outward. The deflector 110 can cause the stinger 112 to deflect laterally outward or to otherwise perform suitable tasks for connecting downhole wet mates. Area 101 may be or include an area of the wellbore 102 that includes a lower completion string 125. In some examples, the area may be or include a production wellbore from which hydrocarbon material or other suitable material can be produced. A fiber optic cable, or other suitable cable or fiber, from the deflector 110 may extend into area 101 to make measurements or perform other wellbore operations.

Figure 1A:
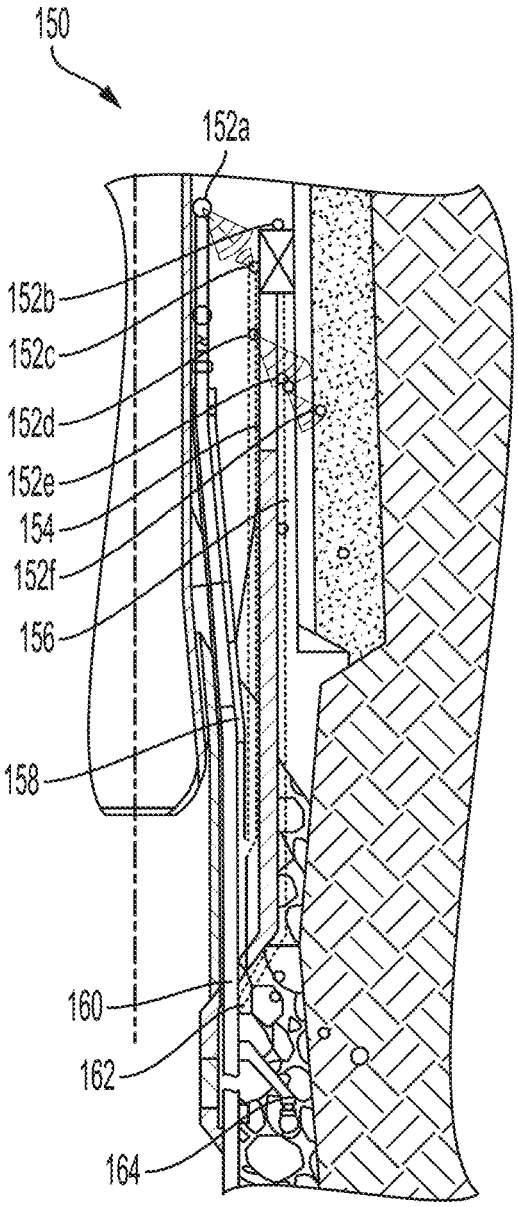
FIG. 1A is a zoomed view of the well system of FIG. 1, according to examples of the present disclosure.

FIG. 1A includes view 150, which may illustrate a portion, such as the casing string 106, the subterranean formation 104, and the like, associated with the wellbore 102. As illustrated in the view 150, the wellbore 102 can include one or more transceivers 152*a-f*, though other suitable numbers (e.g., less than five or more than six) of transceivers are possible to include in the wellbore 102. In some examples, the transceivers 152*a-f* may alternatively be, or additionally include, transponders, sensors, actuators, or the like. Additionally or alternatively, the wellbore 102 may include a first energy transfer mechanism 154 and a second energy transfer mechanism 156. The first energy transfer mechanism 154 may be positioned on an inner surface of or otherwise interior with respect to the lower completion string 125, and the second energy transfer mechanism 156 may be positioned on an outer surface of or otherwise external to the lower completion string 125. The first energy transfer mechanism 154, the second energy transfer mechanism 156, or a combination thereof may be or include a fiber optic line, an electrical line, or the like. Additionally or alternatively, a wet mate 158 may be used to couple the first energy transfer mechanism 154, the second energy transfer mechanism 156, or a combination thereof to a separate energy transfer mechanism. Additionally or alternatively, a feed-through 160, a splitter 162, a branch 164, or a combination thereof may be positioned in the wellbore 102 and may act on one or more energy transfer mechanisms.

Figure 2:
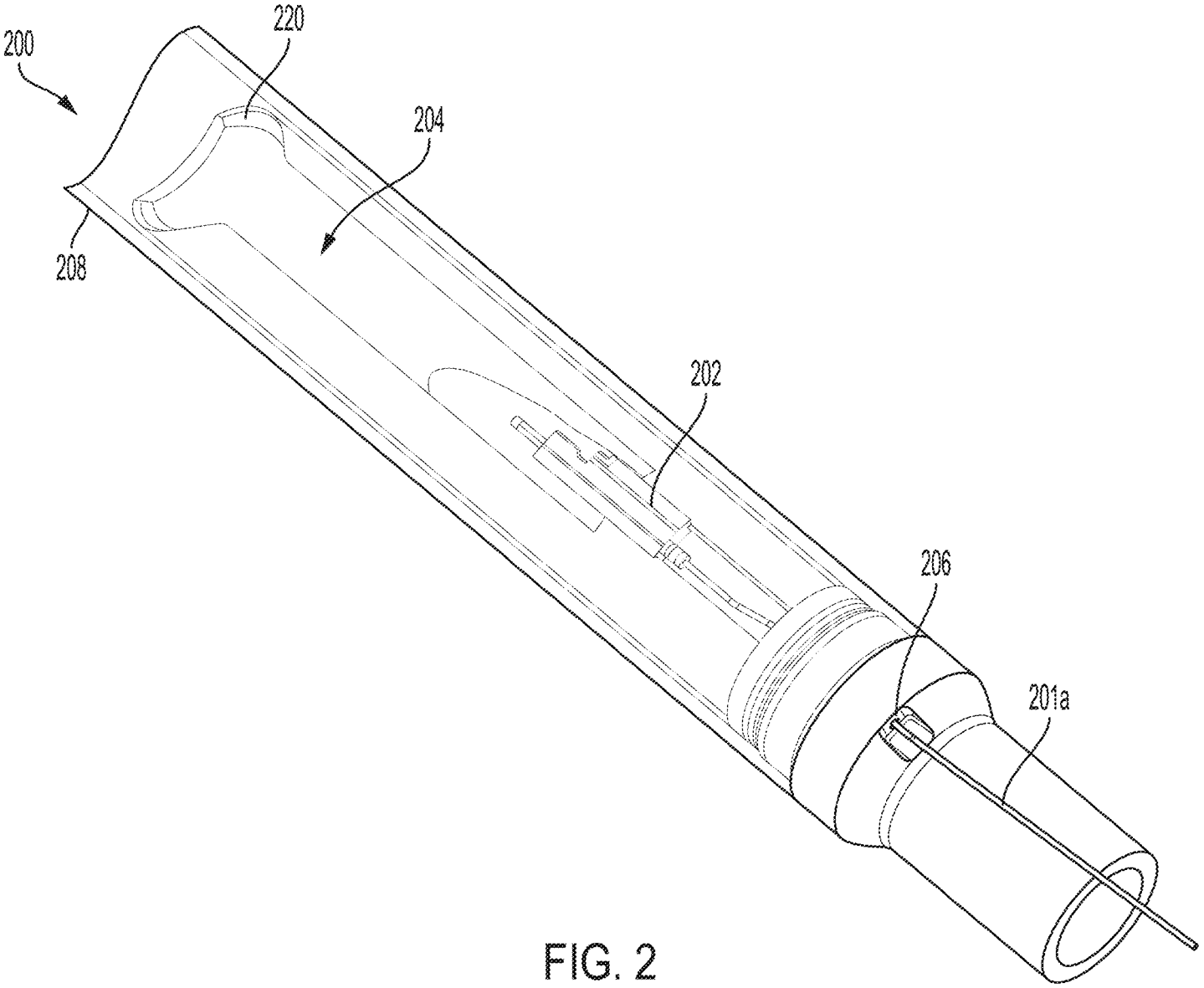
FIG. 2 is a perspective view of an example of a deflector sub-system according to examples of the present disclosure.

FIG. 2 is an example of a deflector sub-system 200 according to one example of the present disclosure. The deflector can include a first energy transfer line 201*a*, a first wet mate connector 202, a deflection ramp 204, a feed-through port 206, a housing 208, any other suitable components or features, or any combination thereof. The first energy transfer line 201*a* may include any suitable line, cable, or the like for transmitting or transferring power, data, pressure, or the like. The deflection ramp 204 may include one or more guiding ramps on an inner diameter of the deflector sub-system 200 that can guide a stinger sub-system to cause the first wet mate connector 202 to receive a second wet mate connector. The feed-through port 206 can allow the first energy transfer line 201*a* to be passed from an interior portion of the deflector sub-system 200 to a location exterior to the deflector sub-system 200.

Figure 3:
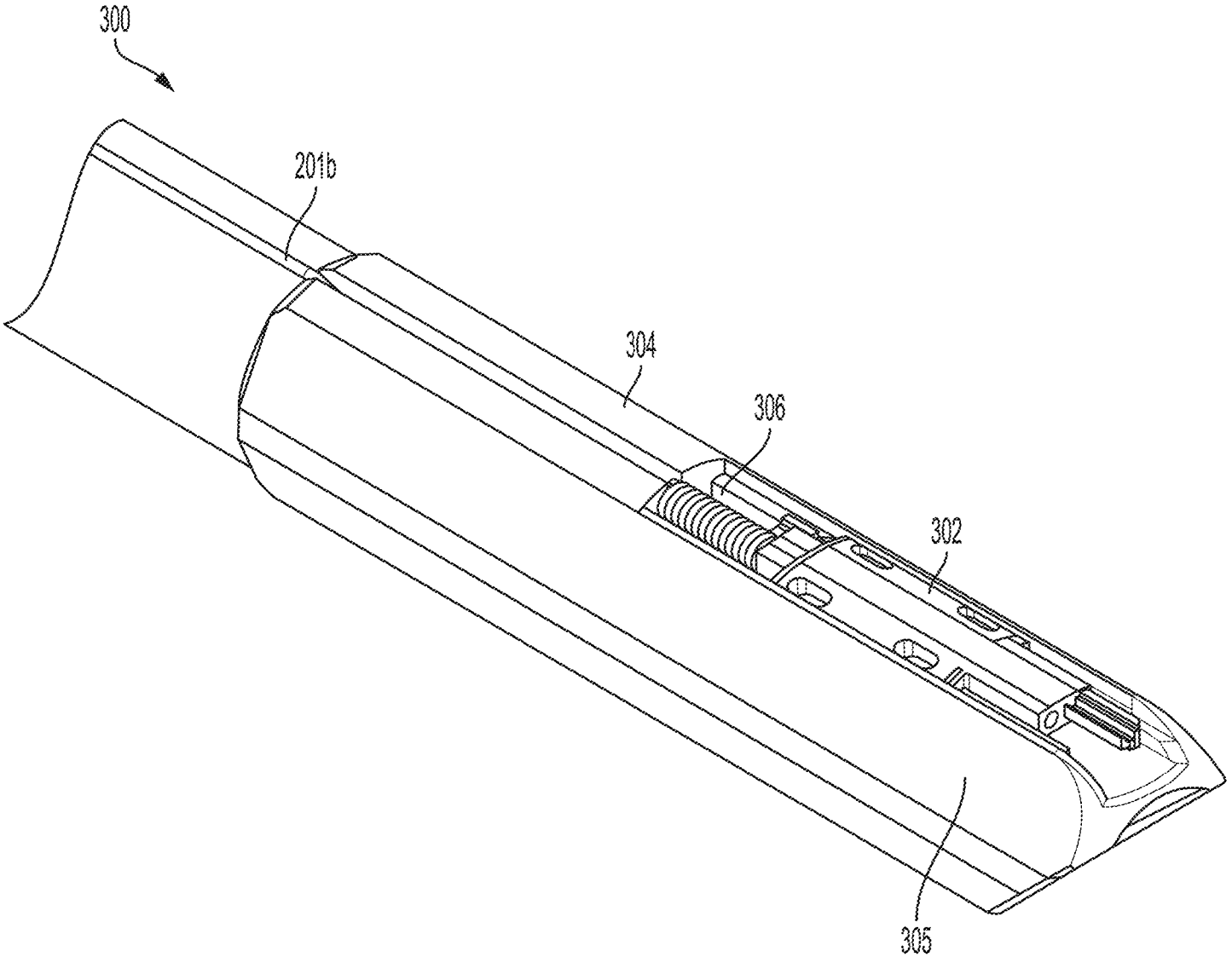
FIG. 3 is a perspective view of an example of a stinger sub-system according to examples of the present disclosure.

FIG. 3 is a perspective view of an example of a stinger sub-system 300 according to examples of the present disclosure. The stinger sub-system 300 can include a second energy transfer line 201*b*, a second wet mate connector 302, a connection between the second energy transfer line and the second wet mate connector 302, a recess 304 for at least one energy transfer line (e.g., the second energy transfer line 201*b*, etc.), one or more features, such as an angled shoulder 305, to allow the stinger sub-system to be guided into the deflector sub-system, a dampening device 306 coupled to the second wet mate connector, and any other suitable features or components, or any combination thereof. In some examples, the stinger sub-system 300, the deflector sub-system 200, or a combination thereof can include two or more wet mate connectors.

In some examples, energy transfer lines, such as the first energy transfer line 201*a*, the second energy transfer line 201*b*, etc., can involve or enable one or more types of energy transfer. For example, the energy transfer line may include one or more fiber optic cables, one or more electrical transfer lines (e.g., electrical conductors such as insulated copper wires), a fluid energy transfer line (e.g., a metal tube such as a control line), or any combination thereof.

In some examples, the energy transfer lines, such as the first energy transfer line 201*a*, the second energy transfer line 201*b*, etc., may include one or more of the following: solid or stranded electrical conductors, coatings (e.g., nickel plating, silver plating, insulation, such as ethylene tetrafluoroethylene (ETFE), ethylene chlorotrifluoroethylene (ECTFE), fluorinated ethylene propylene (FEP), perfluoro alkoxy (PFA), etc.) for the one or more energy transfer lines and components, filler materials (e.g., polypropylene, FEP, PFA), structural components which may be internal, external, adjacent, secured, wrapped, or the like with respect to the one or more energy lines, and other suitable or related components. Structural components may include armor-type devices or members to protect the energy transfer lines or components from damage (e.g., crushing, pinching, abrading, gouging, etc.), high pressures (e.g., which may result in collapsing, bursting, etc.), or a combination thereof. In some examples, the structural components may include one or more of the following: 316L, Alloy 825, Alloy 625, Super Duplex, Corrosion Resistant Alloys (CRA) materials, other metals, other metal alloys, non-metals, composites, cables, fasteners, centralizers, clamps, sleeves, etc. The energy transfer lines may include one or more encapsulations to protect against harsh chemicals, harsh environments, friction, light leakage, electrical leakage including an electrical short, emf radiation, corrosion (e.g., galvanic, pitting, erosion, uniform, hydrogen embrittlement, sulfide stress cracking, etc.), and so on.

An energy transfer line that can transfer multiple streams of one energy type may involve a wet mate connection capable of connecting multiple connections of the same type of energy. For example, an energy transfer line including three fiber optic cables may use a wet mate that can connect three fiber optic cables in unison or in near unison such as nearly at the same time. In such examples, the wet mate may include one or more separate seals for each connection, one or more separate chambers for each connection, one or more separate springs for each connection, one or more separate dampers for each connection, one or more separate gates for each connection, one or more separate chambers for each connection, one or more separate openings for each connection, one or more separate purging or flushing systems for each connection, one or more separate pressure compensation systems for each connection to ensure reliable, repeatable connections and re-connections, and so on.

An energy transfer line including two or more electrical cables or conductors may use a similar wet mate with features discussed above. Additionally or alternatively, the energy transfer line may be designed with respect to electrical energy, for example using electrical insulators, non-conductive materials, etc. An energy transfer line that can transfer more than one energy type may use another wet mate connection that can connect the different types of energy lines without damaging or significantly decreasing the energy level of each form of energy. A wet mate for connecting more than one energy type may include one or more separate seals for each energy type (e.g., a non-conductive seal for electricity, a pressure-resisting seal for fluids, a liquid seal for light/emf energy, etc.). Each energy type may use separate chambers for each connection. One or more separate springs may be used for each energy type. One or more of the following may be used for each energy type: separate dampers, separate gates to prevent fluids from the wellbore from entering the wet mate or energy contact area, separate openings (e.g., sealable doors), separate purging systems to remove foreign matter (e.g., debris, well fluids, etc.), flushing systems to remove foreign matter (e.g., debris, well fluids, etc.), and so on.

In some examples, the second energy transfer line, or other suitable transfer lines, can be substituted for any other suitable cable, conduit, fiber, or energy transfer device. Additionally or alternatively, another energy transfer line, cable, conduit, fiber, or energy transfer device may be added. In some examples, any combination of more than one (e.g., two, three, four, or more) type of energy transfer line, cable, conduit, fiber, or energy transfer device maybe used. Changes, substitutions, additions, or various combinations of energy transfer lines, cables, conduits, fibers, or energy transfer devices can be improved by using the concepts disclosed regarding wet mates, types of conductors, coatings, corrosion prohibitors, insulation, filler materials, structural components, armor devices, different material types, encapsulations, seals, springs, dampers, chambers, sealed openings, purging systems, flushing systems, etc.

Figure 4:
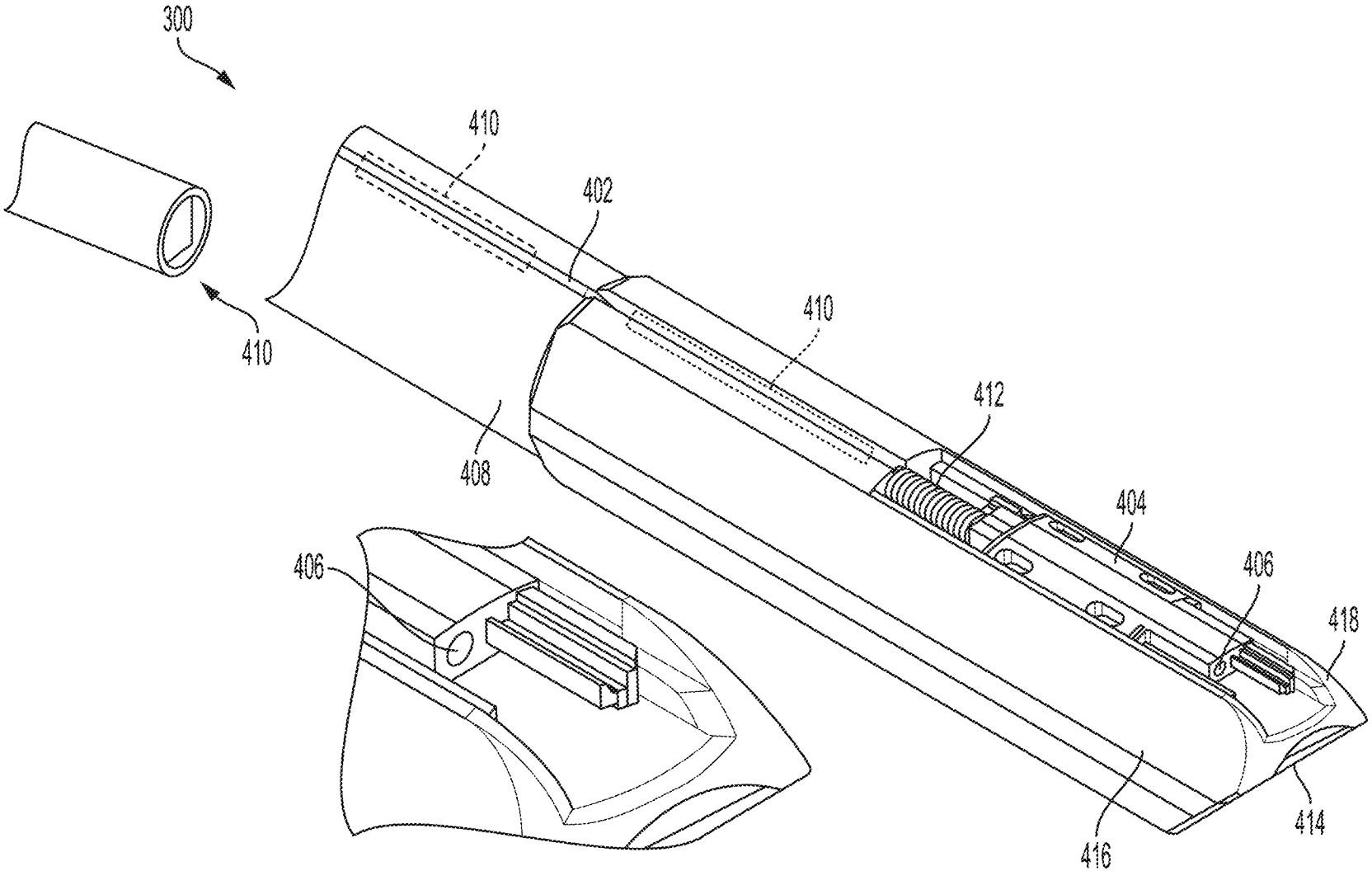
FIG. 4 is a perspective view of an example of a stinger sub-system with features according to examples of the present disclosure.

FIG. 4 is a perspective view of an example of a stinger sub-system 300 with features according to examples of the present disclosure.

Energy Transfer Line

An energy transfer line can be used to transfer one or more energy signals. As illustrated in FIG. 4, an energy transfer line 402 can be used to convey energy to or from the stinger sub-system 300 to another locale, or device, which may be located at the surface of the well or somewhere else (e.g., a feed-through seal assembly, junction block, etc.). The energy transfer line 402 may transfer one or more forms of energy. For example the following forms, or types, of energy or energy transfer may be used: light, electric, fluid (e.g., hydraulic, water, fuel, etc.), magnetic, electromagnetic, thermal including heat, acoustic including sound, motion including mechanical, inductive, etc. The energy transfer line 402 may be used to transfer power, signals, data, information, conditional information, sensed information or data, computed information or data, logical information, filtered or conditioned information, data, or power, unfiltered information, data, or power, and so on. In some examples, the transfer of energy may be continuous (e.g., DC current), alternating (e.g., AC current), pulsed (e.g., digital 1's and 0's, pressure pulses, flow pulses, current or voltage changes, etc.), or the like. The transfer of energy may be unidirectional, such as from the surface downward, or bidirectional such as from the surface downward and from subterranean to surface, etc. There may be more than one energy transfer line such as two or more approximately parallel energy transfer lines. There may be an energy transfer line with one or more types of energy used. For example, there may be two fiber optic fibers run in parallel, there may be three fiber optic lines and one electrical line, there may be two twisted electrical lines, there may be two emf shielded electric lines, etc. There may be one or combinations of the above in various arrangements and combinations.

Wet Mate Connection

A wet mate connection can involve two components, such as halves, which, when mated together, may form a wet mate connection. As illustrated in FIG. 4, an upper wet mate half 404, such as the second wet mate connector 302, can be or include a socket half 406 of the wet mate. The socket half 406 can be represented by the hole near the distal end of the socket half of a wet mate connection in FIG. 4.

The wet mates may use a device for connecting to the energy transfer line 402. The device may include a connection device to provide structural support, such as resistance to axial or lateral forces, etc., to ensure the wet mate and the energy transfer line 402 remain affixed to one another. The connection device may include a soldered, brazed, fused, wedged, swaged mechanical, or pressure-tight union. The connection device may have a sealed liquid-resistance, or gas-resistant, component (e.g., an elastomer seal, an artificial seal, such as polyether ether ketone (PEEK), a quad seal, an O-ring, a metal, etc.). The connection device may have a pressure-compensation feature, for example to reduce an imbalance of pressure external to the components with respect to the pressure inside one or more components of the wet mate half, the energy transfer line 402, or a combination thereof. In some examples, the wet mate and the energy transfer line 402 may involve using a dry mate connection. A dry mate can be a connection that is made on the surface, or in other dry environments, but that can have the functionality of a wet mate when positioned downhole. For example, a dry mate can resist or withstand fluid influx, can be structurally strong enough to resist high external pressure, such as hydrostatic pressure, can provide the transfer of energy without hinderances such as light losses, resistance, etc. A half wet mate and a short energy transfer line may be referred to as a wet mate connector and pigtail. The pigtail may have a dry mate connector at the opposite end of the wet mate connector. In such an arrangement, the wet mate connector may be affixed to the stinger housing in the field shop and tested before shipping the assembly to a wellsite. At the wellsite, the dry mate connector can be connected and tested before running the system into the well.

The stinger sub-system 300 may at least partially be or include a structural component. For example, the stinger sub-system 300 includes a connection feature 408, one or more protection features 410, a coupling movement compensator and damper 412, a flow path 414, one or more alignment features 416, and one or more debris-exclusion features 418. Other or additional features may be included in the stinger sub-system 300.

The connection feature 408 can be used to connect the stinger sub-system 300 to another item such as the deflector sub-system 200. In some examples, a threaded portion of the connection feature 408 can secure the stinger sub-system 300 to a component of the upper completion string such as a joint of tubing. The thread may be a metal-to-metal thread, a thread with a timing feature to maintain its alignment relative to one or more features on the stinger sub-system 300, or the item to which it is connected such as a tubing spacer joint.

The one or more protection features 410 may be or include a recess or protected passage for the energy transfer line 402. The one or more protection features 410 may include a bore or borehole, a groove, a slot, or combinations of these or other forms or features to protect the energy transfer line 402 from damage during run-in-hole operations, production operations, etc. The one or more protection features 410 may additionally or alternatively include features to reduce or prevent damage to the energy transfer line 402 or other components due to friction, vibration, erosion, external forces, etc. Such protection features may include a wear-resistant material such as a ceramic composite. The protection features may also include one or more friction-reducing materials such as Teflon or like material. A friction-reducing feature such as a guide, a rail, a wrap, etc. may be used. In some examples, a ceramic impregnated-Teflon tube or wrap may be positioned over or around the energy transfer line 402 to provide protection from energy sources or energy events, such as flow-induced vibration, tubing movement due to temperature changes, etc., that may create friction, vibration, erosion, etc.

The coupling movement compensator and damper 412 can ensure wet mate components can connect and remain connected. The components of the wet mate may engage substantially contemporaneously with respect to when the stinger sub-system 300, or other device, comes in contact with a beveled diameter of the deflector sub-system 200 or other feature of the deflector sub-system 200 that can prevent the stinger sub-system 300 from progressing further downhole. Machining tolerances, debris interference, and the like can cause the connection of the components of the wet mate to happen sequentially with respect to the stinger sub-system 300 contacting the beveled diameter of the deflector sub-system 200. Therefore, the coupling movement compensator and damper 412 can be used. A spring-like device is illustrated as the coupling movement compensator and damper 412 in FIG. 4. The spring-like device can allow the upper wet mate half 404 to move slightly with respect to a body of the stinger sub-system 300. The spring-like device may allow the wet mate components to couple slightly before the systems come in contact. Likewise, if the stinger sub-system 300 or the deflector sub-system 200 move slightly due thermal expansion, pressure contraction, such as ballooning, etc., the wet mate components can remain coupled as the spring-like device allows them to move while remaining connected.

Additionally or alternatively, the coupling movement compensator and damper 412 can ensure wet mate halves can withstand sudden loads such as shock. In order to protect one or more items of the stinger sub-system 300, the deflector sub-system 200, or a combination thereof from uncontrolled movement, such as shock, sudden motion, fast motion, high loads, large impacts, etc., the coupling movement compensator and damper 412 may be used to control or dampen the amount of energy, such as shock, within the stinger sub-system 300, the deflector sub-system 200, or a combination thereof. For example, the spring-like device of the coupling movement compensator and damper 412 may be or include a dashpot or another damper device. In some examples, the dashpot can resist motion via viscous friction or other suitable resistance mechanisms. The resulting force can be proportional to the velocity but may act in the opposite direction, which may slow a descent of the stinger sub-system 300, thereby absorbing energy. The coupling movement compensator and damper 412 may be a combination of a spring device to absorb energy and a dashpot device. The dashpot can control, or slow, high speeds and a spring can absorb the energy in lieu of the energy being transferred to other components.

The stinger sub-system 300 can include the flow path 414. The flow path 414 may be or include a hole or a port that can allow fluid and tools to pass through the stinger sub-system 300. In some examples, the flow path 414 may be approximately concentric with the thread described above, though the flow path 414 may be otherwise sized, shaped, located, and the like with respect to the stinger sub-system 300.

The stinger sub-system 300 may additionally include guiding and alignment features such as the one or more alignment features 416. The one or more alignment features 416 may assist in guiding the stinger sub-system 300 into the wellbore, through obstructions (e.g., liner tops, packer tops, etc.) in the wellbore, and eventually onto the deflection ramp 204 of the deflector sub-system 200 and engagement with the first wet mate connector 202. The one or more alignment features 416 may include a large-angled feature at a distal end of the stinger sub-system 300 can be sized, shaped, or the like to assist in guiding the stinger sub-system 300 past obstructions and up to the deflection ramp 204. Additionally or alternatively, the one or more alignment features 416 may include smaller, beveled or filleted features at the distal end of the stinger sub-system 300 can ensure the stinger sub-system 300 can move past obstructions. The one or more alignment features 416 can urge the stinger sub-system 300 into precise rotational alignment with the deflector sub-system 200 so that the corresponding wet mate components can be in approximate alignment prior to final engagement. Additionally or alternatively, the wet mate components may have fine, or precise rotational and lateral alignment features to ensure proper engagement of the wet mate components. As illustrated in FIG. 4, the upper wet mate can have a protrusion at its distal end, which can ensure precise rotational alignment of the wet mate components. The protrusion geometry can also ensure precise lateral, such as side-to-side and up-and-down, alignment of the wet mate components prior to engagement, during engagement, and after engagement or connection of the wet mate components.

The foregoing features, or any similar features, may be used on other wet mate components or on another component of the stinger sub-system 300. For example, one or more alignment features 416 may be used on the wet mate components. The first wet mate connector 202 included in the deflector sub-system 200 may have a corresponding feature, or other similar features, to assist in the alignment, engagement, connection, and the like of the wet mate components. Flat axial surfaces on an outer diameter of the stinger sub-system 300 may help align and hold the stinger sub-system 300 in alignment with features of the deflector sub-system 200. In some examples, the flat axial surfaces may prevent the stinger sub-system 300 from rotating out of alignment after the wet mate connector has been connected. The deflector sub-system 200 may have one or more corresponding features or similar features to work with the features on the stinger sub-system 300.

The stinger sub-system 300 can include the one or more debris-exclusion features 418. Mating surface (e.g., inner diameter of socket component, the outer diameter of the plug, the end of plug component) of the sub-systems, of the wet mates, or of any subcomponents thereof can accumulate debris. The one or more debris-exclusion features 418 can ensure the mating surfaces can be kept debris-free during run-in-hole operations and engagement operations of wet mate components. The one or more alignment features 416, such as a protrusion, angled features, etc., can be kept debris-free. Additionally or alternatively, the contact surfaces, such as fiber optic ends, electrical contact areas, etc., etc. can be kept debris-free using the one or more debris-exclusion features 418.

Figure 5:
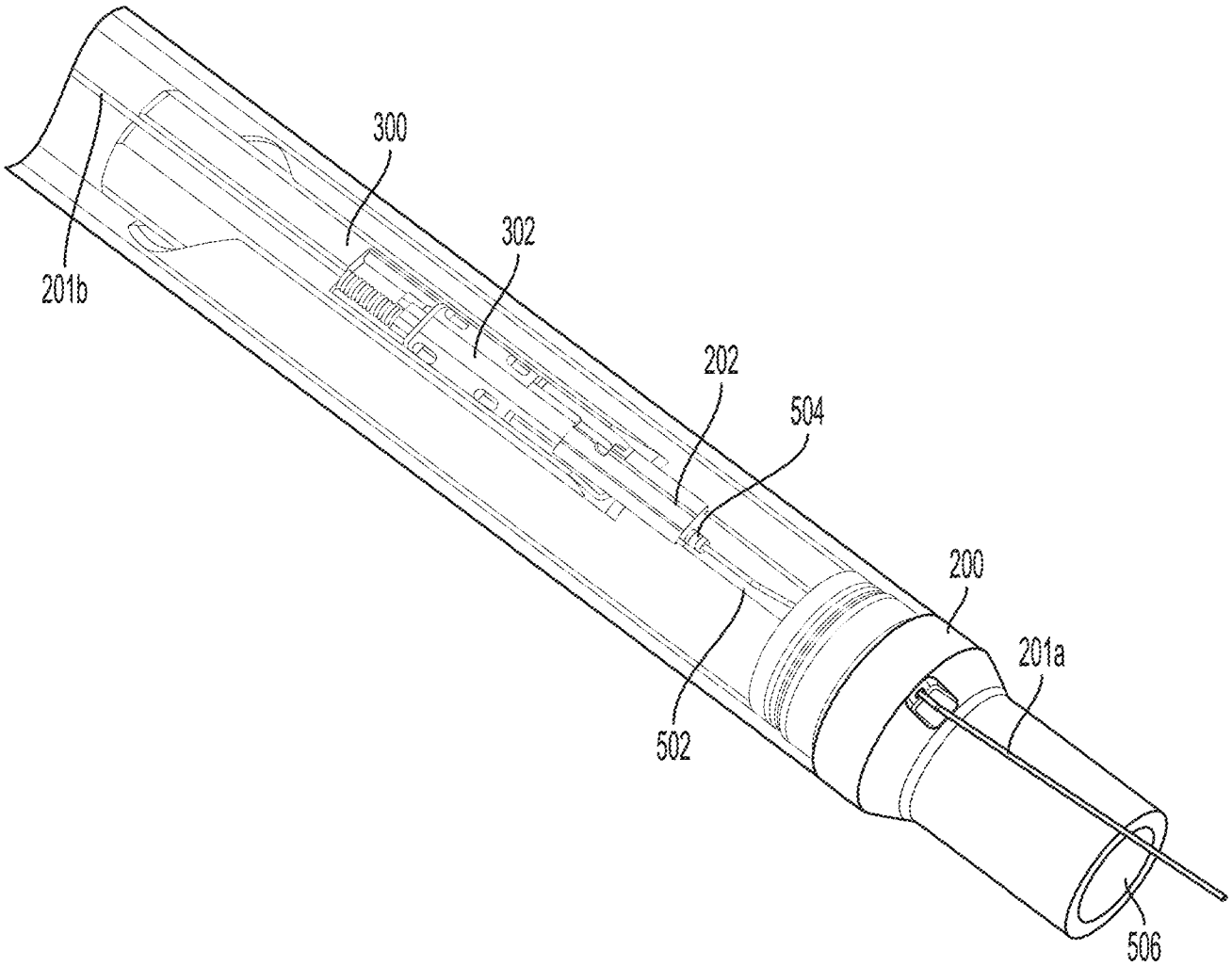
FIG. 5 is a perspective view of an example of the deflector sub-system and the stinger sub-system according to some examples of the present disclosure.

FIG. 5 is a perspective view of an example of the deflector sub-system 200 and the stinger sub-system 300 according to some examples of the present disclosure. As illustrated in FIG. 5, the stinger sub-system 300 can be positioned in the deflector sub-system 200 to cause the first wet mate connector 202 to connect to the second wet mate connector 302. By positioning the stinger sub-system 300 in the deflector sub-system 200, the stinger sub-system 300 may traverse the deflection ramp 204 and may deflect laterally outward to cause the first wet mate connector 202 to connect to the second wet mate connector 302.

The features, techniques, components, and the like described above for the stinger sub-system 300 can be additionally or alternatively implemented or integrated into the deflector sub-system 200 to improve a performance, reliability, and repeatability of operations involving the deflector sub-system 200. An energy transfer line, such as the first energy transfer line 201*a*, may be used to convey energy to or from the deflector sub-system 200 to another locale, or device, which may be located at the bottom of the well or somewhere else such as a feed-through seal assembly, sensors, controllers, valves, inflow control devices, actuators, meters, etc. The energy transfer line may be used to transfer power, signals, data, information, conditional information, sensed information or data, computed information or data, logical information, filtered or conditioned information, data, or power, unfiltered information, data, or power, and so on. The deflector sub-system 200 may include more than one energy transfer line such as two or more approximately parallel energy transfer lines. The energy transfer line may transfer one or more types of energy. For example, there may be two twisted electrical lines, there may be two emf shielded electric lines, etc. Additionally or alternatively, two or more fiber optic fibers may be run in parallel. More than one type of energy transfer line, such as three fiber optic lines and one electrical line, may be mixed, etc. A wet mate-to-energy transfer line connector can be used. The wet mates can use a device for connecting to the energy transfer line. The device may include a connection device to provide structural support, a soldered, brazed, fused, wedged or swaged mechanical or pressure-tight union, a sealed liquid-resistance (or gas-resistant) component, an elastomer seal, a pressure-compensation feature, a dry mate connection, and the like.

The deflector sub-system 200 may include one or more structural components. For example, the deflector sub-system may have a connection feature, a recess or protected passageway 502 for one or more energy transfer lines, a wet mate to energy transfer line connector, wet mate connector, other devices related to the deflector sub-system 200, etc. The deflector sub-system 200 may include one or more features to reduce or prevent damage to the first energy transfer line 201*a* or other components due to friction, vibration, erosion, external forces, and the like including friction-reducing features, such a guide(s), rail(s), wrap(s), wear-resistant materials, and devices, to prevent at least energy sources or events (e.g., flow-induced vibration, tubing movement due to temperature changes, etc.) that may create friction, vibration, erosion, etc.

The deflector sub-system 200 may include one or more features to ensure wet mate components can connect and remain connected. The one or more features may include a spring-like device 504, which may allow the wet mate components to couple, for example, slightly before, or after, the stinger sub-system 300 and the deflector sub-system 200 come in contact. Additionally or alternatively, if the stinger sub-system 300 or the deflector sub-system 200 move slightly due to thermal expansion, pressure contraction (ballooning), etc. the wet mate components can remain coupled. The deflector sub-system 200 may include one or more features to ensure the wet mate components can withstand sudden loads or shock and can control or dampen the amount of energy or shock within the stinger sub-system 300 and the deflector sub-system 200. For example, a dashpot to resist the motion via viscous friction can be used. The resulting force can be proportional to the velocity, but can act in the opposite direction of received force, which can slow the motion and absorb energy. The spring-like device 504 may be used in combination with a dashpot device. The dashpot can control or slow high speeds and a spring can absorb the energy in lieu of the energy being transferred to other components. The deflector sub-system 200 may include at least one flow path (e.g., flow path 506), such as a hole or port, to allow fluid and tools to pass through the deflector sub-system 200. The flow path 506 may be approximately concentric with one thread or connection and eccentric with another thread or connection.

The deflector sub-system 200 may include guiding and alignment features. The deflector sub-system 200 may have large and angled features, such as the deflection ramp 204, to urge the stinger sub-system 300 laterally outward. Additionally or alternatively, the deflector sub-system 200 may have small features to urge or guide the stinger sub-system 300. For example, a small bevel 220 above the deflection ramp 204 can encourage the distal end of the stinger sub-system 300 up and onto the deflection ramp 204. The deflector sub-system 200 may include large and small features to guide the stinger sub-system 300 into precise rotational alignment with the first wet mate connector 202 of the deflector sub-system 200. For example, the first wet mate connector 202 can include a grooved recess into which a protrusion of the second wet mate connector 302 of the stinger sub-system 300 can engage prior to final connection of energy lines or contacts. The recess may improve the alignment of the wet mate components axially and rotationally.

The deflector sub-system 200 may include flat or radial (e.g., curved) surfaces on an inner diameter to help align, guide, or hold the stinger sub-system 300 in a particular position and orientation during landing and engaging processes and when the wet mate components are connected. The deflector sub-system 200 may include debris exclusion features to prevent debris from entering or settling in critical areas including: mating surfaces (e.g., an inner diameter of a socket component, an outer diameter, an end of a plug component, etc.), guiding features (e.g., protrusion, recessed groove, etc.), contact surfaces (e.g., fiber optic ends, electrical contact areas, etc.), and so on.

Figure 6:
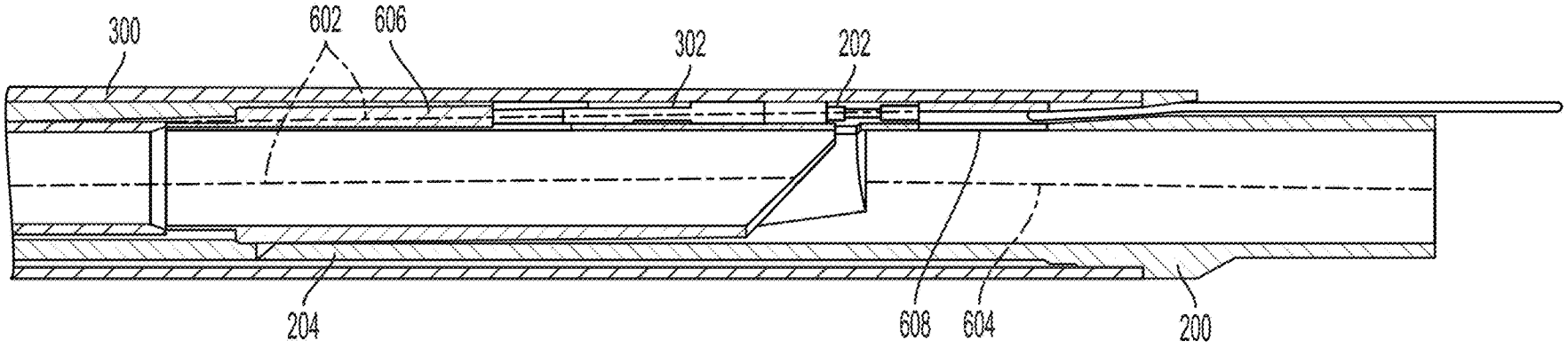
FIG. 6 is a sectional side-view of an example of the stinger sub-system positioned in the deflector sub-system according to some examples of the present disclosure.

FIG. 6 is a sectional side-view of an example of the stinger sub-system 300 positioned in the deflector sub-system 200 according to some examples of the present disclosure. The stinger sub-system 300 can be positioned in the deflector sub-system 200 and can be deflected outward, such as by traversing the deflection ramp 204, to cause the first wet mate connector 202 to connect to the second wet mate connector 302. In some examples, a first axis 602 of a flow path, such as a first upper flow path, of the stinger sub-system 300 can be canted or offset with respect to a second axis 604 of a flow path bore of the deflector sub-system 200. In a particular example, the first axis 602 may be canted or offset from the second axis 604 by an angle of less than approximately 0.5 degrees. In other examples, the angle may be from approximately 0.5 degrees to 1.5 degrees, may be from approximately 1.5 degrees to approximately 2.5 degrees, may be from approximately 2.5 degrees to approximately 3 degrees, may be from approximately 3 degrees to approximately 5 degrees, may be from approximately 5 degrees to approximately 10 degrees, may be from approximately 10 degrees to approximately 20 degrees, may be more than approximately 20 degrees, etc. In some examples, the first axis 602 may be substantially parallel (e.g., within 1%, 2%, 3%, etc.) with respect to a third axis 606 that follows the trajectory of the second wet mate connector 302. Additionally or alternatively, the second axis 604 may be offset from a fourth axis 608 that follows the trajectory of the first wet mate connector 202. The offset may be less than one degree, from one degree to two degrees, from two degrees to three degrees, or so on. In some examples, the offset may be similar or identical to the cant or offset between the first axis 602 and the second axis 604.

In some examples, to achieve a large flow path area, such as a projected flow area, through the stinger sub-system 300 and the deflector sub-system 200, the first axis 602 of the stinger sub-system 300 and the second axis 604 of the deflector sub-system 200 may intersect within less than approximately 0.05 inches to approximately 1 inch, from approximately 1 inch to approximately 3 inches, etc. from a furthest distal end of an opening of the stinger sub-system 300. In other examples, the first axis 602 of the stinger sub-system 300 and the second axis 604 of the deflector sub-system 200 may intersect within approximately 3 inches from the furthest distal end of the opening of the stinger sub-system 300, within approximately 6 inches from the furthest distal end of the opening of the stinger sub-system 300, within approximately 9 inches from the furthest distal end of the opening of the stinger sub-system 300, within approximately 12 inches from the furthest distal end of the opening of the stinger sub-system 300, etc.

In some examples, to achieve a large passage way for passing tools or for a large projected passage area, the first axis 602 of the stinger sub-system 300 and the second axis 604 of the deflector sub-system 200 may be canted or offset to a lesser degree to allow a larger, unencumbered passage of a drift bar or tool through a flow bore passing through the stinger sub-system 300 and the deflector sub-system 200. In a particular example, the drift bar or tool may be between approximately 36 inches (91.44 cm)-48 inches (121.92 cm) long with a full-length outside diameter of approximately 96-99.6% of the inner diameter of the flow bore of the stinger sub-system 300. In some examples, the first axis 602 of the stinger sub-system 300 and the second axis 604 of the deflector sub-system 200 may be canted or offset to a larger angle to allow an increase in the deflection of a wet mate connector. In a particular example, this may reduce passage of a drift bar or tool of between approximately 38 inches (96.52 cm)-46 inches (116.84 cm) inch long with a full-length outside diameter to approximately 92-96% of the inner diameter of the flow bore of the stinger sub-system 300. In some examples, a larger angle than those discussed above may be used, but could further reduce the full-length outside diameter of drift bar or tool.

In some aspects, systems and methods for a deflector and a stinger for connecting downhole fiber optic wet mates are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a first completion system positionable in a wellbore, the first completion system comprising a stinger sub-system that comprises a first energy transfer line coupled to a first wet mate connector; and a second completion system positionable in the wellbore, the second completion system comprising a deflector sub-system that comprises a deflector positioned adjacent to a second wet mate connector that is coupled with a second energy transfer line, the deflector positioned in the second completion system to deflect the stinger sub-system laterally outward to cause the second wet mate connector to couple with the first wet mate connector.

Example 2 is the system of example 1, wherein a first axis of the first wet mate connector is substantially parallel to a second axis that follows a flow path defined by the stinger sub-system.

Example 3 is the system of example 1, wherein a first axis of the second wet mate connector is offset from a second axis that follows a flow path defined by the deflector sub-system.

Example 4 is the system of example 1, wherein the stinger sub-system further comprises one or more alignment features located on a front end of the stinger sub-system, and wherein the one or more alignment features are positioned to cause the first wet mate connector to align with the second wet mate connector.

Example 5 is the system of any of examples 1-4, wherein the deflector comprises a deflection ramp, wherein a first axis that follows a central path of the deflection ramp is substantially parallel to a second axis that follows a central path of the second wet mate connector.

Example 6 is the system of example 1, wherein the stinger sub-system further comprises a damping feature coupled to the first wet mate connector, and wherein the damping feature comprises a spring.

Example 7 is the system of any of examples 1 and 6, wherein the first energy transfer line comprises an electricity transfer line, a fiber optic cable, or a hydraulic transfer line, and wherein the damping feature further comprises a dashpot.

Example 8 is a deflector sub-system comprising: a housing defining a flow path; a first wet mate connector located on an external surface of the housing, the first wet mate connector coupled with an energy transfer line; and a deflector located adjacent to the first wet mate connector, the deflector positioned in the housing to deflect a stinger sub-system laterally outward to cause a second wet mate connector of the stinger sub-system to couple with the first wet mate connector.

Example 9 is the deflector sub-system of example 8, wherein a first axis of the first wet mate connector is offset from a second axis that follows the flow path.

Example 10 is the deflector sub-system of example 8, wherein the deflector sub-system further comprises one or more alignment features located on a front end of the deflector sub-system, and wherein the one or more alignment features are positioned to cause the first wet mate connector to align with the second wet mate connector.

Example 11 is the deflector sub-system of example 8, wherein the deflector comprises a deflection ramp, wherein a first axis that follows a central path of the deflection ramp is substantially parallel to a second axis that follows a central path of the first wet mate connector.

Example 12 is the deflector sub-system of example 8, wherein the deflector sub-system further comprises a damping feature coupled to the first wet mate connector, and wherein the damping feature comprises a spring and a dashpot.

Example 13 is the deflector sub-system of any of examples 8-12, wherein a first axis of the first wet mate connector is substantially parallel to a second axis that follows a flow path defined by the stinger sub-system when the stinger sub-system is positioned on the deflector.

Example 14 is the deflector sub-system of any of examples 8-12, wherein the energy transfer line comprises an electricity transfer line, a fiber optic cable, a hydraulic transfer line, or a combination thereof.

Example 15 is a system comprising: a stinger sub-system positionable in a wellbore, the stinger sub-system comprising (i) a first energy transfer line coupled to a first wet mate connector, and (ii) one or more alignment features; and a deflector sub-system positionable in the wellbore, the deflector sub-system comprising a deflector positioned adjacent to a second wet mate connector that is coupled with a second energy transfer line, the deflector positioned to deflect the stinger sub-system laterally outward to cause the second wet mate connector to couple with the first wet mate connector.

Example 16 is the system of example 15, wherein a first axis of the first wet mate connector is substantially parallel to a second axis that follows a flow path defined by the stinger sub-system.

Example 17 is the system of example 15, wherein a first axis of the second wet mate connector is offset from a second axis that follows a flow path defined by the deflector sub-system.

Example 18 is the system of example 15, wherein the one or more alignment features are located on a front end of the stinger sub-system, and wherein the one or more alignment features are positioned to cause the first wet mate connector to align with the second wet mate connector.

Example 19 is the system of example 15, wherein the deflector comprises a deflection ramp, wherein a first axis that follows a central path of the deflection ramp is substantially parallel to a second axis that follows a central path of the second wet mate connector.

Example 20 is the system of example 15, wherein the stinger sub-system further comprises a damping feature coupled to the first wet mate connector, and wherein the damping feature comprises a spring or a dashpot.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A deflector sub-system comprising:

a housing defining a flow path;

a first wet mate connector located on an external surface of the housing, the first wet mate connector coupled with an energy transfer line; and a deflector located adjacent to the first wet mate connector, the deflector positioned in the housing and comprising a deflection ramp to deflect a stinger sub-system laterally and within the deflector sub-system to cause a second wet mate connector of the stinger sub-system to couple with the first wet mate connector, the deflection ramp extending from a first position within the deflector sub-system to a second position within the deflector sub-system, the first position adjacent to an entrance of the deflector sub-system, the second position positioned further into the deflector sub-system than the first position, and a surface of the deflection ramp approaching a central axis of the deflection sub-system from the first position to the second position.

2. The deflector sub-system of claim 1, wherein a first axis of the first wet mate connector is offset from a second axis that follows the flow path.

3. The deflector sub-system of claim 1, wherein the deflector sub-system further comprises one or more alignment features located on a front end of the deflector sub-system, and wherein the one or more alignment features are positioned to cause the first wet mate connector to align with the second wet mate connector.

4. The deflector sub-system of claim 1, wherein a first axis that follows a central path of the deflection ramp is substantially parallel to a second axis that follows a central path of the first wet mate connector.

5. The deflector sub-system of claim 1, wherein the deflector sub-system further comprises a damping feature coupled to the first wet mate connector, and wherein the damping feature comprises a spring and a dashpot.

6. The deflector sub-system of claim 1, wherein a first axis of the first wet mate connector is substantially parallel to a second axis that follows a flow path defined by the stinger sub-system when the stinger sub-system is positioned on the deflector.

7. The deflector sub-system of claim 1, wherein the energy transfer line comprises an electricity transfer line, a fiber optic cable, a hydraulic transfer line, or a combination thereof.

8. A system comprising:

a first completion system positionable in a wellbore, the first completion system comprising a stinger sub-system that comprises a second energy transfer line coupled to a second wet mate connector; and a second completion system positionable in the wellbore, the second completion system comprising a deflector sub-system that comprises a deflector positioned adjacent to a first wet mate connector that is coupled with a first energy transfer line, the deflector positioned in the second completion system and comprising a deflection ramp to deflect the stinger sub-system laterally and within the deflector sub-system to cause the second wet mate connector to couple with the first wet mate connector, the deflection ramp extending from a first position within the deflector sub-system to a second position within the deflector sub-system, the first position adjacent to an entrance of the deflector sub-system, the second position positioned further into the deflector sub-system than the first position, and a surface of the deflection ramp approaching a central axis of the deflection sub-system from the first position to the second position.

9. The system of claim 8, wherein a first axis of the first wet mate connector is substantially parallel to a second axis that follows a flow path defined by the stinger sub-system.

10. The system of claim 8, wherein a first axis of the second wet mate connector is offset from a second axis that follows a flow path defined by the deflector sub-system.

11. The system of claim 8, wherein the stinger sub-system further comprises one or more alignment features located on a front end of the stinger sub-system, and wherein the one or more alignment features are positioned to cause the first wet mate connector to align with the second wet mate connector.

12. The system of claim 8, wherein a first axis that follows a central path of the deflection ramp is substantially parallel to a second axis that follows a central path of the second wet mate connector.

13. The system of claim 8, wherein the stinger sub-system further comprises a damping feature coupled to the first wet mate connector, and wherein the damping feature comprises a spring.

14. The system of claim 13, wherein the first energy transfer line comprises an electricity transfer line, a fiber optic cable, or a hydraulic transfer line, and wherein the damping feature further comprises a dashpot.

15. A system comprising:

a stinger sub-system positionable in a wellbore, the stinger sub-system comprising (i) a second energy transfer line coupled to a second wet mate connector, and (ii) one or more alignment features; and a deflector sub-system positionable in the wellbore, the deflector sub-system comprising a deflector positioned adjacent to a first wet mate connector that is coupled with a first energy transfer line, the deflector comprising a deflection ramp and positioned to deflect the stinger sub-system laterally and within the deflector sub-system to cause the second wet mate connector to couple with the first wet mate connector, the deflection ramp extending from a first position within the deflector sub-system to a second position within the deflector sub-system, the first position adjacent to an entrance of the deflector sub-system, the second position positioned further into the deflector sub-system than the first position, and a surface of the deflection ramp approaching a central axis of the deflection sub-system from the first position to the second position.

16. The system of claim 15, wherein a first axis of the first wet mate connector is substantially parallel to a second axis that follows a flow path defined by the stinger sub-system.

17. The system of claim 15, wherein a first axis of the second wet mate connector is offset from a second axis that follows a flow path defined by the deflector sub-system.

18. The system of claim 15, wherein the one or more alignment features are located on a front end of the stinger sub-system, and wherein the one or more alignment features are positioned to cause the first wet mate connector to align with the second wet mate connector.

19. The system of claim 15, wherein a first axis that follows a central path of the deflection ramp is substantially parallel to a second axis that follows a central path of the second wet mate connector.

20. The system of claim 15, wherein the stinger sub-system further comprises a damping feature coupled to the first wet mate connector, and wherein the damping feature comprises a spring or a dashpot.

* * * * *